US005463183A

United States Patent [19]

Konno

[11] Patent Number: 5,463,183

[45] Date of Patent: Oct. 31, 1995

[54] MUSICAL TONE FORMING APPARATUS

[75] Inventor: Fumitomo Konno, Hamamatsu, Japan

[73] Assignee: Yamaha Corporation, Japan

[21] Appl. No.: 233,381

[22] Filed: Apr. 26, 1994

[30] Foreign Application Priority Data

Apr. 27, 1993 [JP] Japan ..... 5-101557

[51] Int. Cl.[6] ..... G10H 1/057; G10H 1/06; G10H 7/00

[52] U.S. Cl. ..... 84/604; 84/622; 84/627

[58] Field of Search ..... 84/604–607, 622–625, 84/627

[56] References Cited

FOREIGN PATENT DOCUMENTS 61-22398 1/1986 Japan .
6-36588 2/1994 Japan .
6-35473 2/1994 Japan .

*Primary Examiner*—Stanley J. Witkowski
*Attorney, Agent, or Firm*—Graham & James

[57] ABSTRACT

A musical tone forming apparatus employed by an electronic musical instrument, comprises an external storage unit, a transfer DMA, a waveform RAM and a sound-source circuit. The external storage unit stores data representing a waveform of a musical tone, wherein the waveform comprises an attack portion and its remaining portion. The waveform RAM provides an attack-waveform storage area, exclusively used for storing attack-waveform data representing the attack portion, and a buffer storage area exclusively used for storing other waveform data representing the remaining portion. Before the production of the musical tone, the transfer DMA transfers the attack-waveform data to the waveform RAM, so that the attack-waveform data is stored in the attack-waveform storage area in advance. Thereafter, when a tone-generation instruction is given, the sound-source circuit reads out the attack-waveform data from the waveform RAM, so that the sound-source circuit forms a former part of the musical tone signal on the basis of the read attack-waveform data. At the same time, the transfer DMA transfers the other waveform data to the waveform RAM, so that the other waveform data are stored in the buffer storage area. After completely reading out the attack-waveform data, the sound-source circuit starts to read out the other waveform data from the waveform RAM, so that a latter part of the musical tone signal is formed on the basis of the read other waveform data. The former and latter parts of the musical tone signal are sequentially outputted from the sound-source circuit, so that one musical tone is produced.

9 Claims, 10 Drawing Sheets

MUSICAL TONE FORMING APPARATUS

BACKGROUND OF THE INVENTION

1. Field of the Invention

The present invention relates to a musical tone forming apparatus which is employed by an electronic musical instrument and the like.

2. Prior Art

In an example of the musical tone forming apparatus which is employed by the electronic musical instrument, a waveform memory is provided to store musical-tone-waveform data representing instantaneous values of a musical tone waveform, from its start portion to its end portion, of an acoustic sound which is produced by an acoustic musical instrument (i.e., non-electronic musical instrument); and then, the stored data are read out to form a musical tone signal. However, a large storage capacity should be required for the waveform memory to store all of the musical-tone-waveform data with respect to each tone color, each tone pitch and each register. Therefore, if a semiconductor memory is used for the waveform memory, there is a problem that the cost for manufacturing the apparatus should be raised up. Thus, it can be proposed that instead of using the semiconductor memory, a magnetic disk unit is used for the waveform memory. Because, the magnetic disk unit has a large storage capacity and the price thereof is relatively inexpensive. However, when using the magnetic disk unit, there occurs another problem that the production of the musical tone cannot be performed simultaneously with the depression of the key of the keyboard, because the read-out speed of the magnetic disk unit is not so high.

Under the consideration of the above-mentioned problems, some apparatus as disclosed in Japanese Patent Publication No. 64-1800 is proposed. This apparatus is characterized by providing two kinds of storage units. Herein, a first storage unit is made by the semiconductor memory which is exclusively used for the read-out operations and whose read-out speed is relatively high, while a second storage unit is made by the magnetic disk unit, and the like, whose storage capacity is relatively large. The first storage unit stores a part of musical-tone-waveform data relating to an attack portion of the musical tone waveform, wherein the attack portion corresponds to a certain period of time "T" from the rise time of the musical-tone waveform. The second storage unit stores another part of musical-tone-waveform data relating to a remaining portion of the musical tone waveform other than the attack portion.

In another apparatus as disclosed in Japanese Patent Laid-Open Publication No. 61-22398, both of the first and second storage units are made by the magnetic disk unit. Herein, the storage area of the first storage unit is divided into a plurality of sectors, each of which stores the musical-tone-waveform data relating to the attack portion of the musical tone waveform such that the data stored in one sector overlaps with the data stored in another sector. According to this apparatus, when the key is depressed, the musical-tone data relating to the attack portion of the musical tone waveform corresponding to the depressed key is read from the first storage unit, so that a first musical tone signal corresponding to the attack portion of the musical tone waveform is generated at first. During the generation of the first musical tone signal, the second storage unit is accessed, so that the musical-tone-waveform data relating to the remaining portion of the musical tone waveform other than the attack portion is read-out. After a certain period of time "T" is passed, a second musical tone signal corresponding to the above-mentioned remaining portion of the musical tone waveform is generated. Herein, a selector is provided to alternatively output either the data read from the first storage unit and the data read from the second storage unit. The above-mentioned configuration of the apparatus is advantageous in that a delay in the production of the musical tone can be eliminated; therefore, it is possible to instantaneously start the reproduction of the musical tone waveform stored in the magnetic disk unit externally provided.

In the known musical tone forming apparatus as described above, it is necessary to reproduce the musical tone waveform without causing any discontinuous points. In order to do so, just after the first musical tone signal is outputted, the second musical tone signal should be simultaneously outputted. As described before, the first musical tone signal relates to the attack portion of the musical tone waveform and is generated by the data read from the first storage unit, while the second musical tone signal relates to the remaining portion of the musical tone waveform and is generated by the data read from the second storage unit. For this reason, a buffer memory is conventionally provided between the second storage unit and the selector, for example. The buffer memory can be configured by a first-in-first-out memory (i.e., FIFO memory). Since the buffer memory temporarily stores an output signal of the second storage unit, it is possible to adjust output timings of the data respectively read from the first and second storage units. Thus, the musical tone forming apparatus conventionally known must have a complex configuration. In addition, the conventional apparatus requires the circuits for connecting the two storage units, so that the size of the apparatus must be enlarged. In fact, the musical tone forming apparatus conventionally known suffer from those problems.

SUMMARY OF THE INVENTION

It is an object of the present invention to provide a musical tone forming apparatus which is capable of forming the musical tone signal on the basis of the waveform data stored in the storage unit externally provided without causing any delay in the production of the musical tone.

According to a fundamental configuration of the present invention, a musical tone forming apparatus comprises an external storage unit, a transfer DMA, a waveform RAM and a sound-source circuit. The external storage unit, such as the magnetic storage unit, stores data representing a waveform of a musical tone, wherein the waveform comprises an attack portion and its remaining portion. The waveform RAM provides an attack-waveform storage area, exclusively used for storing attack-waveform data representing the attack portion, and a buffer storage area exclusively used for storing other waveform data representing the remaining portion. Before the production of the musical tone, the transfer DMA transfers the attack-waveform data to the waveform RAM, so that the attack-waveform data is stored in the attack-waveform storage area in advance. Thereafter, when a tone-generation instruction is given, the sound-source circuit reads out the attack-waveform data from the waveform RAM, so that the sound-source circuit forms a former part of the musical tone signal on the basis of the read attack-waveform data. At the same time, the transfer DMA transfers the other waveform data to the waveform RAM, so that the other waveform data are stored in the buffer storage area. After completely reading out the attack-waveform data, the sound-source circuit starts to read out the other waveform data from the waveform RAM, so that a latter part of the musical tone signal is formed on the basis of the read other waveform data.

The above-mentioned former and latter parts of the musical tone signal are sequentially outputted from the sound-source circuit, so that a sound system can smoothly produces one musical tone.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings.

DESCRIPTION OF THE PREFERRED EMBODIMENT

Figure 1:
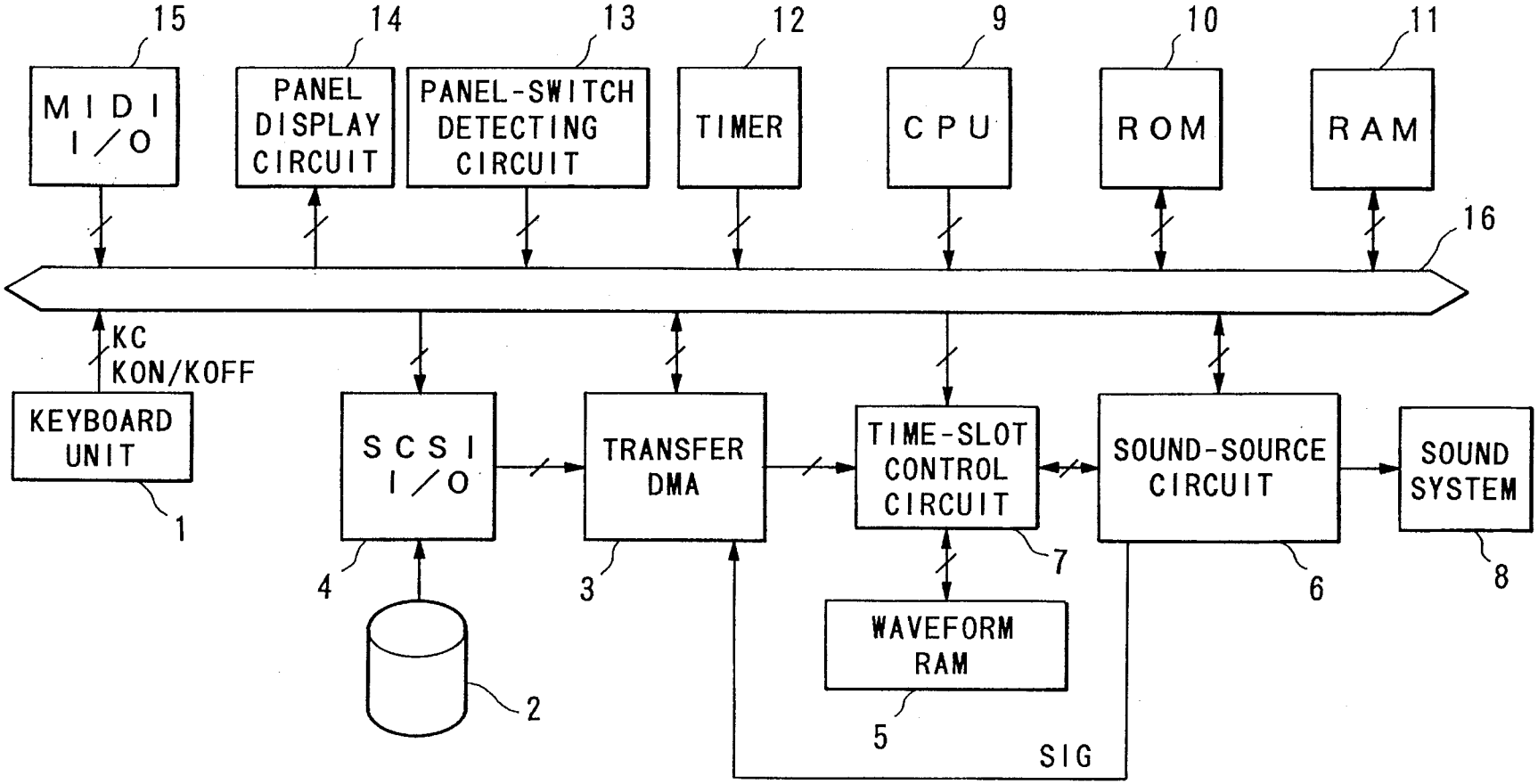
FIG. 1 is a block diagram showing a whole configuration of an electronic musical instrument employing a musical tone forming apparatus according to an embodiment of the present invention.

Now, an embodiment of the present invention will be described by referring to the drawings.

[A] Whole Configuration of Electronic Musical Instrument

Figure 2:
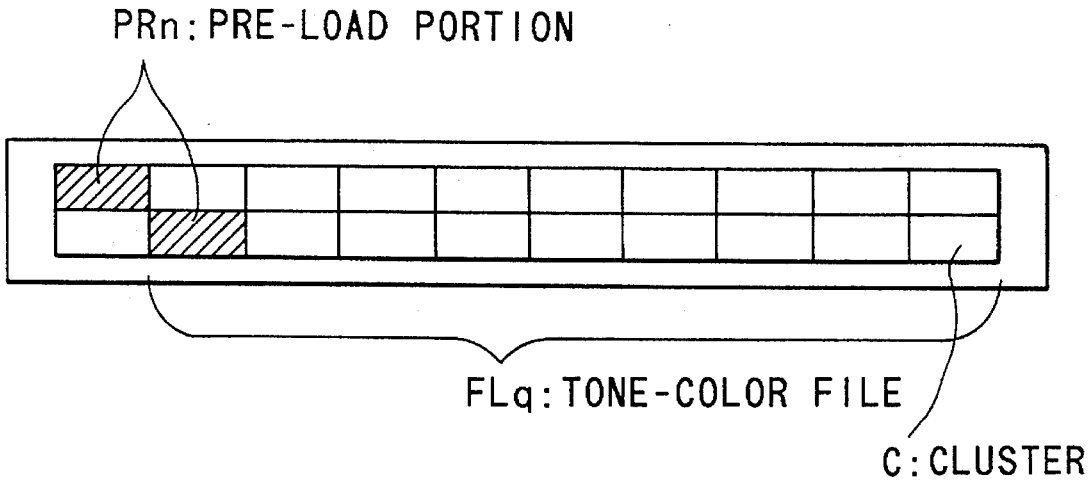
FIG. 2 is a drawing showing a part of a magnetic disk on which data are stored.

FIG. 1 is a block diagram showing the whole configuration of the electronic musical instrument employing a musical tone forming apparatus according to an embodiment of the present invention. In FIG. 1, a numeral 1 denotes a keyboard unit providing a keyboard containing a plurality of keys. When a key is depressed, the keyboard unit 1 creates a key-on signal KON and a keycode KC. Herein, the key-on signal KON indicates that the key is depressed, while the keycode KC represents the tone pitch of the depressed key. The key-on signal KON and the keycode KC are outputted onto a data bus 16. A numeral 2 denotes a magnetic disk unit whose storage capacity is large. The musical tone waveform of each musical tone to be produced is divided into two portions, i.e., the attack portion and its continuing portion. Herein, the attack portion of the musical tone waveform is represented by first musical-tone-waveform data (or attack-waveform data), while the continuing portion of the musical tone waveform is represented by second musical-tone-waveform data. A pair of the first and second musical-tone-waveform data are stored in the magnetic disk unit 2 in connection with each of the musical tones to be produced. FIG. 2 shows the contents of the data stored in the magnetic disk. In FIG. 2, each row corresponds to each track of the magnetic disk. A tone-color file FLq (where q ranges from "1" to "n"), which is recorded on the magnetic disk and is provided in connection with each tone color, consists of a plurality of clusters each denoted by a symbol "C". A top cluster "C", provided for each tone-color file FLq, is used as a pre-load portion PRq (where q ranges from "1" to "n") on which the first musical-tone-waveform data, relating to the attack portion of the musical tone waveform, is recorded. Each tone-color file FLq consists of a plurality of waveform files which are provided in connection with each of the registers.

In FIG. 1, a numeral 3 denotes a transfer DMA (where "DMA" means a direct memory access), which reads out the musical-tone-waveform data from the magnetic disk unit 2 so as to transfer it directly to a waveform random-access memory (i.e., waveform RAM) 5 without intervening the data bus 16. A numeral 4 denotes a small computer system interface (abbreviated as "SCSI"), which is used when the transfer DMA 3 reads out the musical-tone-waveform data from the magnetic disk unit 2. The waveform RAM 5 has two kinds of storage areas, i.e., an attack-waveform storage area and a buffer storage area. Herein, the attack-waveform storage area is provided to store the first musical-tone-waveform data relating to the attack portion of the musical tone waveform, while the buffer storage area is provided to store the second musical-tone-waveform data relating to the remaining portion of the musical tone waveform. The details of the waveform RAM 5 will be described later.

A numeral 6 denotes a sound-source circuit which is configured by a PCM sound source and the like, wherein PCM is an abbreviation for 'Pulse Code Modulation'. The sound-source circuit 6 sequentially reads out the musical-tone-waveform data from the waveform RAM 5 on the basis of the information supplied thereto through the data bus 16; and then, the sound-source circuit 6 forms and outputs the musical tone signal based on the read musical-tone-waveform data. The sound-source circuit 6 provides four tone-generation channels each performing a process of forming a musical tone signal. The sound-source circuit 6 performs the above-mentioned processes for the four tone-generation channels in a time-division-multiplex system. Each tone-generation channel can independently forms the musical tone signal. The details of the sound-source circuit 6 will be described later. A numeral 7 denotes a time-slot control circuit which performs a timing control such that a writing operation to write the data into the waveform RAM 5 by the transfer DMA 3 is performed simultaneously with a reading operation to read the data from the waveform RAM 5 by the sound-source circuit 6. A circuit configuration by which the RAM is simultaneously accessed by the DMA and the sound source is proposed by the present applicant in the Japanese Patent Application No. 4-210944. A numeral 8 denotes a sound system which converts the musical tone signal, outputted from the sound source 6, into an analog signal, so that a speaker will produce a musical tone in response to the analog signal.

Next, a numeral 9 denotes a central processing unit (i.e., CPU) which inputs information from the keyboard unit 1 and a panel-switch detecting circuit 13 and which also inputs data from a read-only memory (i.e., ROM) 10 and a random-access memory (i.e., RAM) 11 so as to control several kinds of circuit portions such as the sound-source circuit 6 and a panel-display circuit 14. The ROM 10 stores control programs which are used when the CPU 9 performs several kinds of control operations. The RAM 11 stores several kinds of coefficients which are used when the CPU 9 performs the control operations based on the control programs; and the RAM 11 also stores a plurality of tone color data each of which corresponds to each of the tone colors. The number of the tone colors provided for the electronic musical instrument is set at 'n' (where 'n' is an integral number to be arbitrarily set).

A timer 12 supplies a clock signal to the CPU 9 through the data bus 16 by a predetermined time interval. The aforementioned panel-switch detecting circuit 13 detects on/off states of panel switches which are arranged on a panel face of an operation panel (not shown). Then, the detected on/off state of each panel switch is outputted onto the data bus 16. As the panel switches, there are provided tone-color-select switches, waveform-load switches and the like. The tone-color-select switch is provided to designate a tone-color number TC which represents a certain tone color used for the musical tones to be produced. The waveform-load switch is provided to designate a loading location, representing one of the storage areas in the waveform RAM, at which the musical-tone-waveform data, read from the magnetic disk unit 2, is loaded (or transferred). The panel-display circuit 14 is provided for controlling a visual display configured by light-emitting diodes (i.e., LEDs) or a liquid crystal display (i.e., LCD). Under the control of the panel-display circuit 14, the tone-color number and a tone-color name which are set by operating the tone-color-select switches are visually displayed. A numeral 15 denotes a MIDI interface (where MIDI is an abbreviation for 'Musical Instrument Digital Interface') providing a MIDI terminal to which an external device can be connected. When the external device is connected, an input signal from the external device is supplied to the CPU 9 through the data bus 16 by means of the MIDI interface 15.

Figure 3:
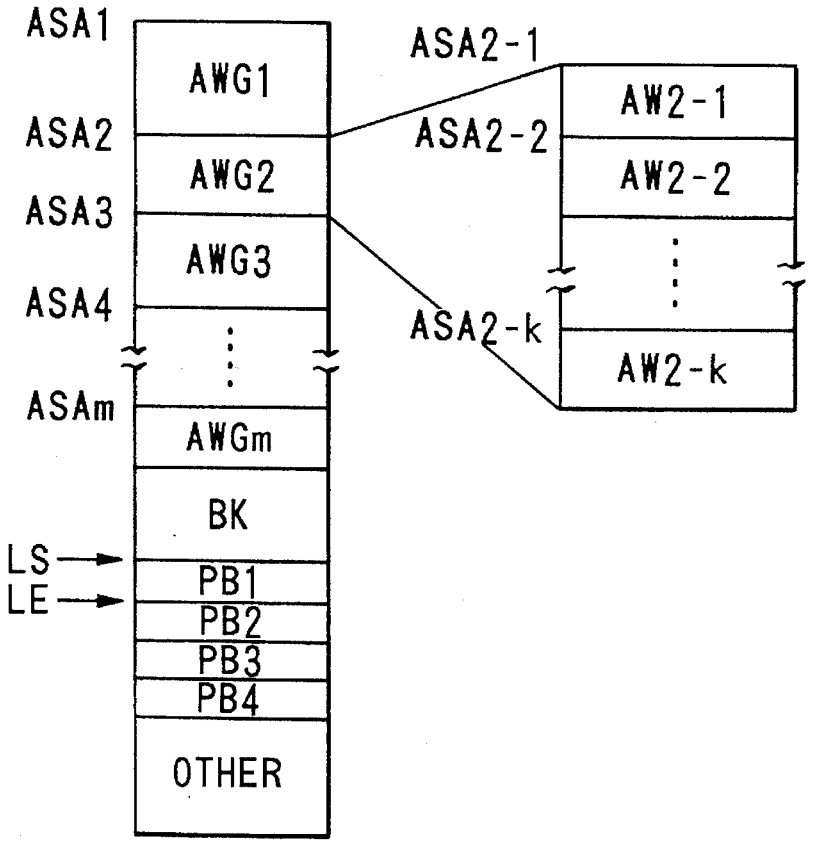
FIG. 3 is a memory map of a waveform RAM shown in FIG. 1.

Next, the detailed configuration of the waveform RAM 5 will be described. FIG. 3 shows a memory map of the waveform RAM 5. In the waveform RAM 5, there are provided a plurality of attack-waveform-group storage areas, each denoted by a symbol "AWGp" (where p ranges from "1" to "m", and "m" is a certain integral number which indicates a number of the tone colors provided for the electronic musical instrument and which is smaller than "n"). Each of the attack-waveform-group storage areas AWG1–AWGm corresponds to each of the tone colors, the number of which is set at "m". Each attack-waveform-group storage area AWGp is defined by a set of addresses which are started from a start address ASAp (where p ranges from "1" to "m"). For example, the first attack-waveform-group storage area AWG1 is started from a start address ASA1, while the last attack-waveform-group storage area AWGm is started from a start address ASAm. In FIG. 2, the pre-load portion PRq of the magnetic disk 2 stores a plurality of attack-waveform data which are provided in connection with each register. Thus, those attack-waveform data stored in the pre-load portion PRq are transferred to each attack-waveform-group storage area AWGp. For example, if the whole range of the keyboard is divided into plural registers whose number is indicated by "k", a plurality of attack-waveform data, whose number is equal to "k", are stored in each attack-waveform-group storage area AWGp. In the case of the attack-waveform-group storage area AWG2, there are provided attack-waveform-data storage areas AW2-1 to AW2-k, the number of which is equal to "k" which also indicates the number of the registers included in the keyboard. Since a data length of one attack-waveform-group storage area may differ from that of another attack-waveform-group storage area, it is necessary to adjust a difference between them. In order to do so, there is provided an idle area BK. The waveform RAm 5 also provides four buffers PB1 to PB4 which are used for a long-time reproduction of the recorded sounds. The musical-tone-waveform data other than the data stored in the pre-load portion PRq shown in FIG. 2 are loaded to the buffers PB1 to PB4 by a unit of the cluster C. In the present embodiment, each of the buffers PB1 to PB4 is configured by a double buffer. Hence, each buffer has a storage area whose minimum size is equal to the data size of the two clusters. Incidentally, the waveform RAM 5 also provides a storage area, denoted by a symbol "OTHER", which stores the other data.

Figure 4A:
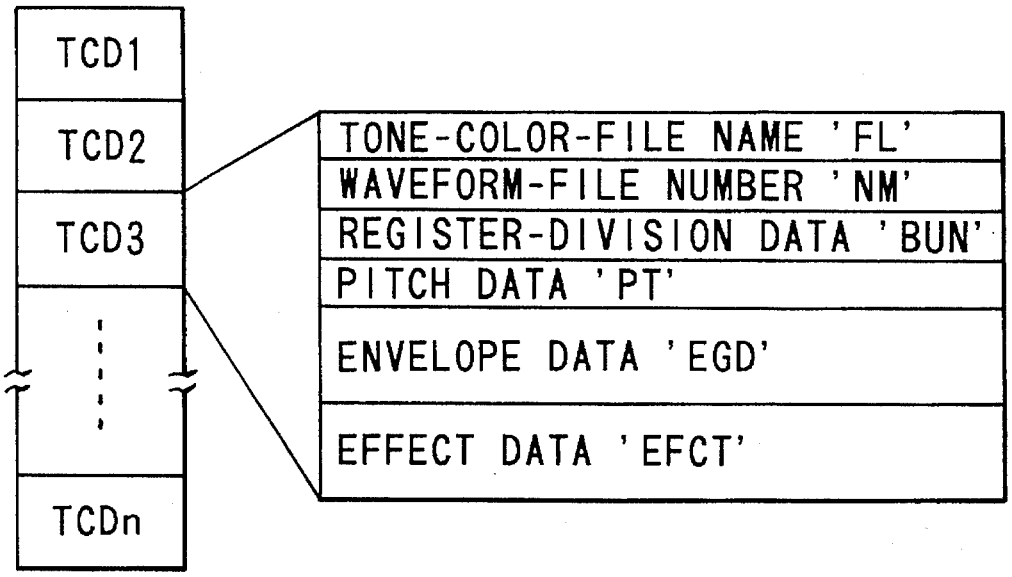
FIGS. 4A to 4C are memory maps for a RAM shown in FIG. 1.
Figure 4B:
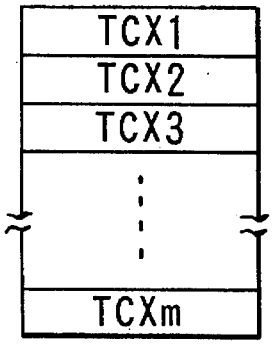
Figure 4C:
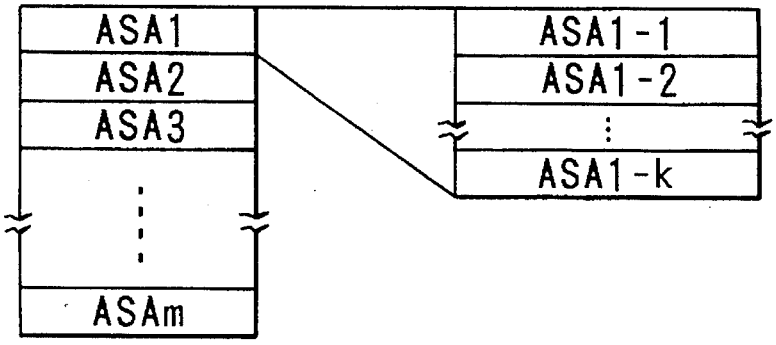

FIGS. 4A to 4C show memory maps for the RAM 11. As shown in FIG. 4A, a plurality of tone color data TCDq (where q ranges from "1" to "n") are disposed in an order of the tone-color number TC. Each tone color data TCDq consists of a tone-color-file name FL, a waveform-file number NM (where this number represents the number of the waveform files), register-division data BUN, pitch data PT, envelope data EGD and effect data EFCT. Herein, one tone-color-file name FL is determined with respect to each tone color. The tone-color-file name FL is added with each of extensions w01 to w0k, the number of which is equal to k indicating the number of the registers included in the keyboard. Thus, the tone-color-file name added with the certain extension can represent a certain waveform-file name corresponding to each register. For example, when the tone color of the saxophone is designated, the tone-color-file name is indicated by a symbol "SAX", by which a plurality of waveform-file names "SAX.w01", "SAX.w02", . . . , "SAX.w0k" are defined. Then, the number k is stored as the waveform-file number NM. Incidentally, the number k (i.e., a register-division number k) representing the number of the registers which are obtained by dividing the whole range of the keyboard is determined in connection with each tone color. The register-division data BUN is provided to establish a certain relationship between each waveform file and the register. The pitch data PT is provided to modulate the pitch of the musical tone according to needs. The envelope data EGD represents the information relating to the time parameters and levels of the envelope waveform generated by an envelope generator EG (not shown) which is provided in the sound-source circuit 6. The effect data EFCT represents the information which is used to set the sound effect which is imparted to the musical tones by an effecter EF (not shown) provided in the sound-source circuit 6.

The RAM 11 also has a storage area, as shown in FIG. 4B, which is exclusively provided for storing the tone-color numbers TC of the attack-waveform data which are loaded to the waveform RAM 5 from the magnetic disk. This storage area has a capacity which can store certain data for plural tone-color numbers TC, the number of which is equal to "m". When the loading of data is performed with respect to a certain tone-color number, this storage area stores loaded-tone-color number TCXp (where p ranges from "1" to "m"). Further, the start addresses ASAp-1 to ASAp-k for the attack-waveform-data storage areas, provided for each attack-waveform-group storage area AWGp in the waveform RAM 5, are stored in the RAM 11 as shown in FIG. 4C.

Figure 5:
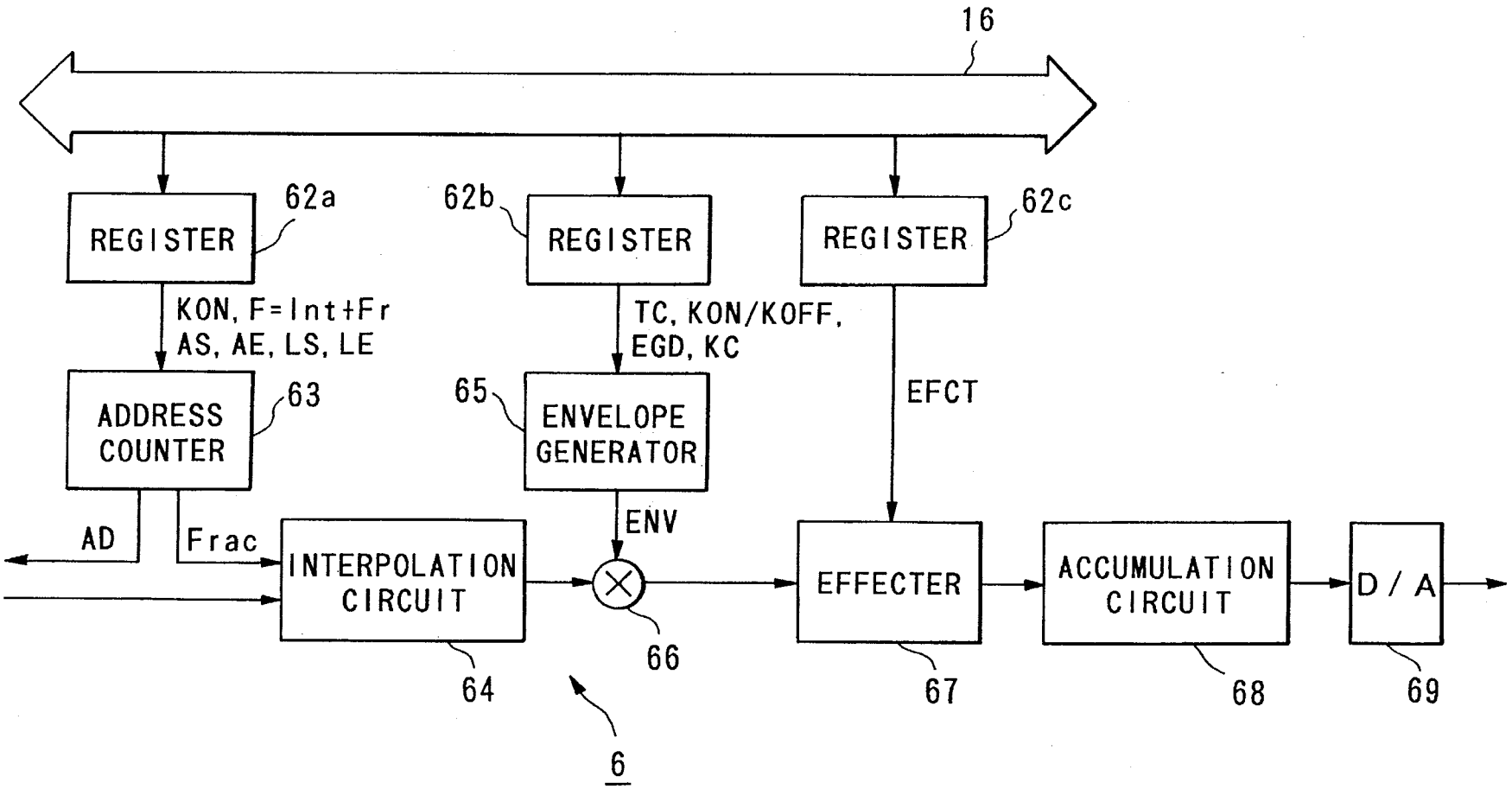
FIG. 5 is a block diagram showing a detailed configuration of a sound-source circuit shown in FIG. 1.
Figure 6:
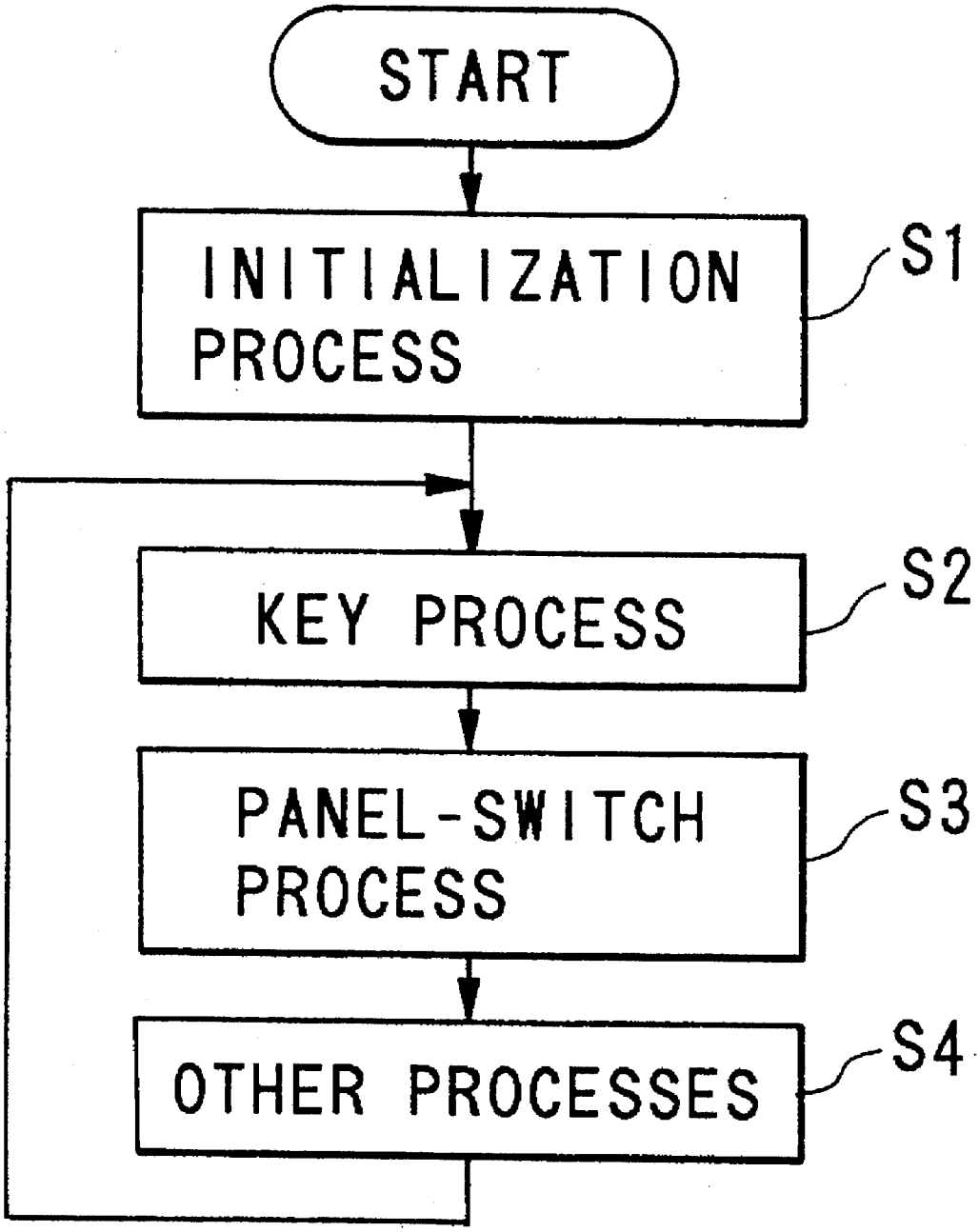
FIG. 6 is a flowchart showing a main routine.

Next, FIG. 5 is a block diagram showing a detailed configuration of the sound-source circuit 6 shown in FIG. 1. In FIG. 5, numerals 62*a* to 62*c* denote registers which stores the keycode KC, the key-on signal KON and the key-off signal KOFF from the data bus 16 as well as several kinds of data which are read from the RAM 11 by the CPU 9. Those data are written into the registers in connection with each tone-generation channel. The register 62*a* provides means which converts the keycode KC into a frequency number 'F'. This frequency number F is used to designate the pitch of the musical tone. The frequency number F consists of an integral part Int and a decimal part Fr. The register 62*a* receives a pair of an attack-start address AS and an attack-end address AE defining the storage area which stores the attack-waveform data within the musical-tone-waveform data to be read from the aforementioned waveform RAM 5. In addition, the register 62*a* also receives a pair of a loop-start address LS and a loop-end address LE defining one of the buffers PB1 to PB4 which stores the above musical-tone-waveform data. The details of the above-mentioned attack-start address AS, attack-end address AE, loop-start address LS and loop-end address LE will be described later.

A numeral 63 denotes an address counter which is configured by a phase generating circuit and an address creating circuit. In a first mode of the address counter 63 where the attack-waveform data is read out, the frequency number F given from the register 62*a* is repeatedly accumulated in accordance with the predetermined number of clocks; and then, a result of accumulation is added with the attack-start address AS. A result of addition is then divided into an integral part and a decimal part. The integral part is used as read-address data AD for reading out the attack-waveform data from the waveform RAM 5 and is outputted to the waveform RAM 5 through the time-slot control circuit 7. At the same time, the decimal part is used as interpolation data Frac and is supplied to an interpolation circuit 64. In a second mode of the address counter 63 where the musical-tone-waveform data corresponding to the remaining portion of the musical tone waveform other than the attack portion is read out, the above-mentioned result of the accumulation for accumulating the frequency numbers F is added with the loop-start address LS. Then, a result of addition is divided into an integral part and a decimal part. The integral part is used as the read-address data AD. Simultaneously with outputting the read-address data AD, the decimal part is outputted as the interpolation data Frac. The interpolation circuit 64 performs an interpolation, based on the interpolation data Frac given from the address counter 63, on the musical-tone-waveform data which is read out from the waveform RAM 5 by the read-address data AD. Herein, a first-order linear interpolation using the interpolation data Frac can be performed between two sampling values which are disposed adjacent to each other within the musical-tone-waveform data; or another higher-order interpolation can be performed between two or more sampling values.

The register 62*b* receives the key-on signal KON, the key-off signal KOFF, the keycode KC and the tone-color number TC as well as the envelop data EGD which is read from the RAM 11 by the CPU 9. Hence, the register 62*b* outputs those data to an envelope generator 65. In response to the key-on signal KON or key-off signal KOFF, the envelope generator 65 starts or stops generating an envelope signal ENV having a waveshape which is defined by the envelope data EGD, the keycode KC and the tone-color number TC. A multiplier 66 multiplies an output signal of the interpolation circuit 64 by the envelope signal ENV outputted from the envelope generator 65.

The register 62*c* receives the effect data EFCT which is read from the RAM 11 by the CPU 9, so that the effect data EFCT is outputted to an effecter 67. On the basis of the effect data EFCT, the effecter 67 imparts a reverberation effect to an output signal of the multiplier 66. Hence, the effecter 67 outputs the musical tone signals corresponding to respective tone-generation channels in a time-division manner. An accumulation circuit 68 accumulates waveform values of those musical tone signals. Then, a digital-to-analog converter (i.e., D/A converter) 69 converts an output signal of the accumulation circuit 68 into an analog signal, which is then supplied to the sound system 8 shown in FIG. 1.

Next, several kinds of variables used for controlling the electronic musical instrument will be described. Those variables are set in a certain storage area of the RAM 11.

① Selected-tone-color number KTC

When the tone-color-select switches are operated to designate the tone color, the tone-color number TC representing the designated tone color is set as the selected-tone-color number KTC.

② MIDI-tone-color channel MTCx

When a MIDI device is used as an input means for inputting performance information (e.g., keycode KC, key-on signal KON, key-off signal KOFF, etc.), it is necessary to determine a certain tone color for the MIDI channel. In order to do so, the tone-color number TC which is designated by operating the tone-color-select switches is set as the MIDI-tone-color channel MTCx.

③ Number data i, j

The number data indicates one of the numbers "1" to "m". The number data i, j determine a storing position of the attack-waveform data in the waveform RAM 5. Therefore, when the value indicated by the tone-color number TC is set to the RAM 11 as the loaded-tone-color number TCXi, a head address of the waveform RAM to which the musical-tone-waveform data is loaded is set equal to the start address ASAi.

④ Position data KTX

The position data KTX indicates a certain storage area, within the attack-waveform-group storage areas AWGp in the waveform RAM, to which the attack-waveform data corresponding to the tone-color number TC designated by the aforementioned selected-tone-color number KTC is to be loaded.

⑤ Load-tone-color number BUF

The tone-color number TC, which is designated by operating waveform-load switches and which indicates the tone color of the musical-tone-waveform data to be loaded to the waveform RAM 5 from the magnetic disk, is set as the load-tone-color number BUF.

⑥ Keycode data KCD

The keycode KC corresponding to the key at which the key-on event or key-off event is occurred is set as the keycode data KCD.

⑦ Tone-generation-channel data ATG

The tone-generation-channel data ATG represents the number of the tone-generation channel to which the key corresponding to the key-on event is assigned.

⑧ Attack-start address AS

The attack-start address AS indicates a start address of the storage area, in the waveform RAM 5, in which the attack-waveform data corresponding to the musical tone to be generated is stored.

⑨ Attack-end address AE

The attack-end address AE indicates an end address of the storage area, in the waveform RAM 5, in which the attack-waveform data corresponding to the musical tone to be generated is stored.

⑩ Buffer data ALP

The buffer data ALP indicates the number of one of the buffers PB1 to PB4 which is used when producing the sound.

⑪ Loop-start address LS

The loop-start address LS indicates a start address of the buffer designated by the buffer data ALP.

⑫ Loop-end address LE

The loop-end address LE indicates an end address of the buffer designated by the buffer data ALP.

[B] Operations

Next, operations of the musical tone forming apparatus according to the present embodiment will be described by referring to the flowcharts shown in FIGS. 6 to 9.

Figure 7:
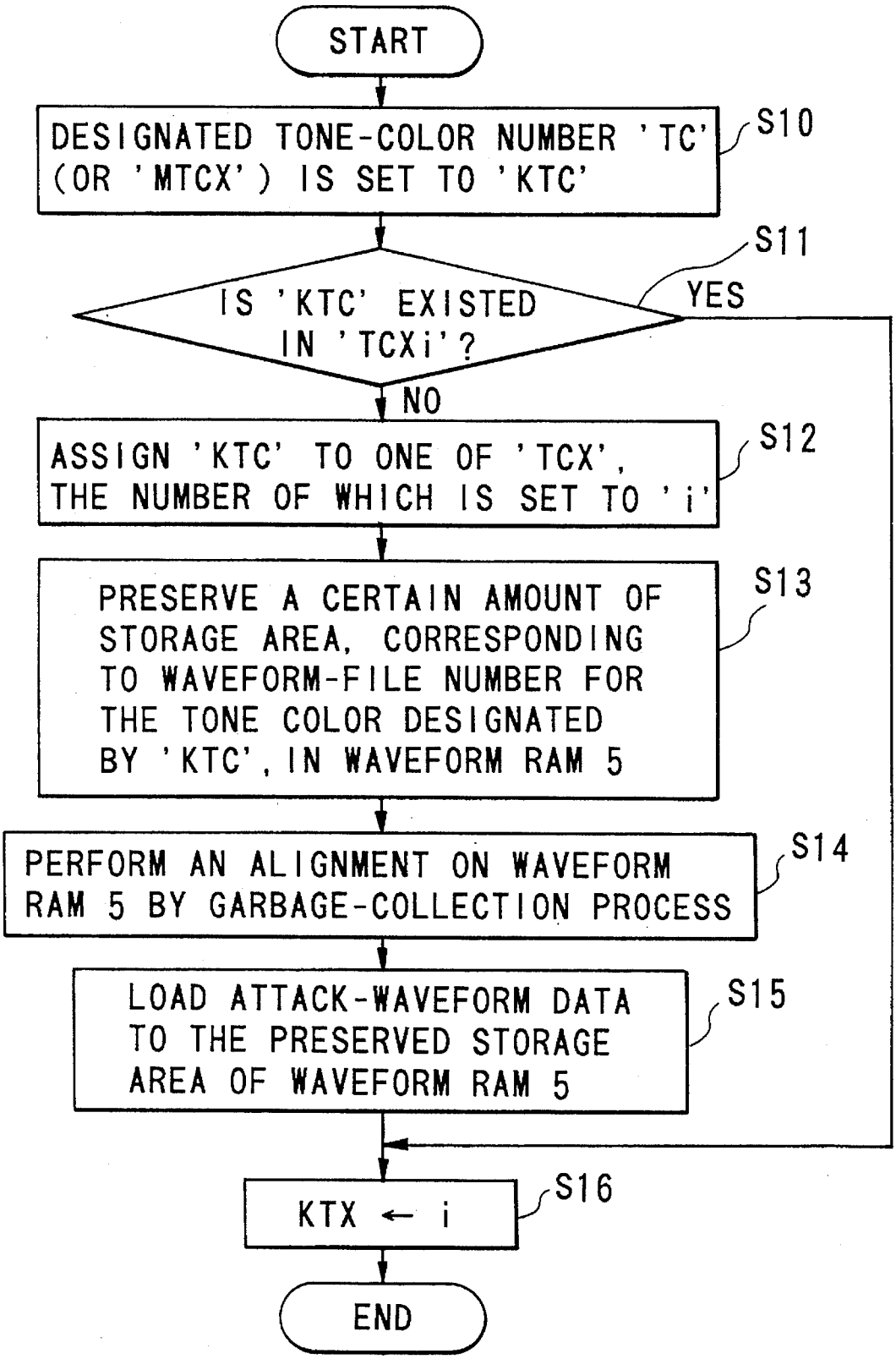
FIG. 7 is a flowchart showing a routine of tone-color-select process.
Figure 8:
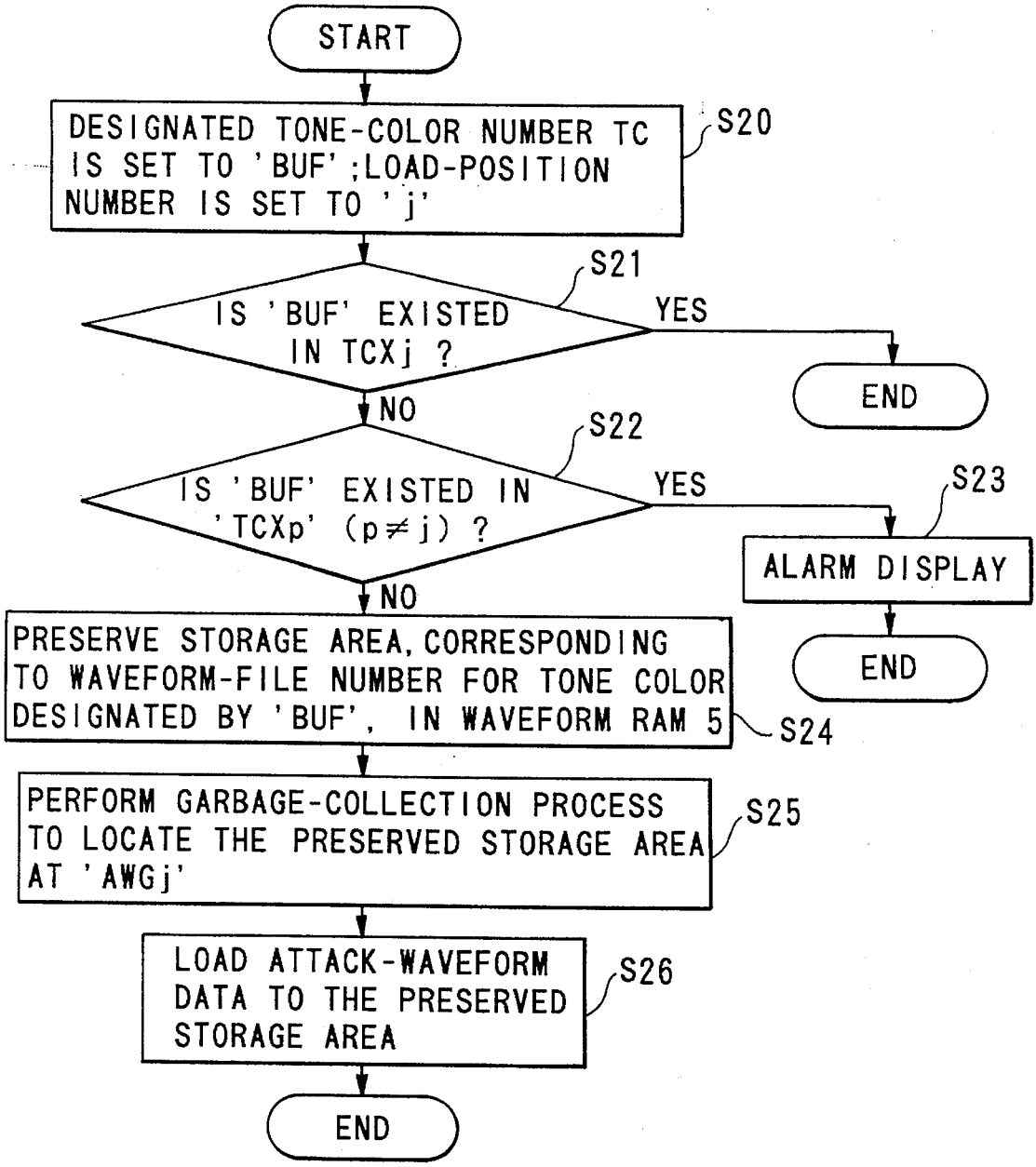
FIG. 8 is a flowchart showing a routine of waveform-load process.
Figure 9:
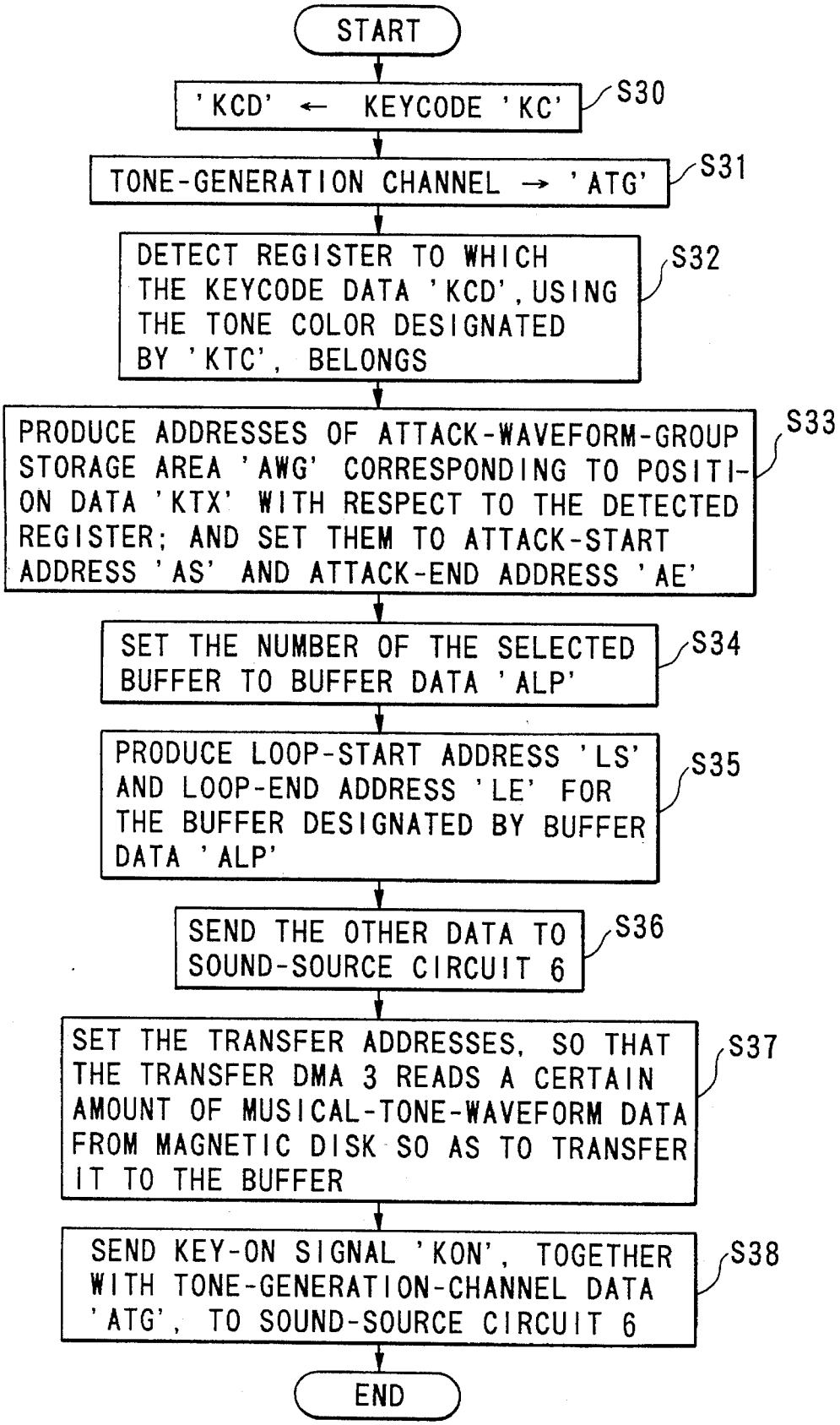
FIG. 9 is a flowchart showing a routine of key-on-event process.

When the power is applied to the electronic musical instrument, the CPU 9 starts to execute a main routine as shown in FIG. 9. At first, the processing of the CPU 9 proceeds to step S1 in which an initialization process is carried out. Due to the execution of the initialization process, several kinds of registers are initialized, while several kinds of variables are also initialized. In step S2, a key process is executed so that the CPU 9 scans the keys of the keyboard unit 1 so as to monitor whether a new key-on event or a new key-off event is occurred. If the key-on event is detected, the CPU starts to execute a routine of key-on-event process as shown in FIG. 9. In contrast, if none of the key-on event and key-off event is detected, the processing of the CPU 9 advances to step S3. Incidentally, when the key-off event is detected, a key-off signal KOFF is sent to the tone-generation channel, to which the key corresponding to the key-off event is assigned, in the sound-source circuit 6. Thus, this tone-generation channel is controlled to be set in a muting state, and the assignment of the key to this tone-generation channel is released. In step S3, a panel-switch process is executed so that the CPU 9 scans the panel switches by the panel-switch detecting circuit 13 so as to monitor whether any one of the panel switches is operated. If the tone-color-select switch is operated among the panel switches, the CPU 9 executes a routine of tone-color-select process as shown in FIG. 7. On the other hand, if the waveform-load switch is operated among the panel switches, the CPU 9 executes a routine of waveform-load process as shown in FIG. 8. In step S3, when it is detected that none of the panel switches is operated, the processing of the CPU 9 advances to step S4. In step S4, the CPU 9 executes other processes. For example, when the MIDI device is used instead of the keyboard unit, the CPU 9 executes a MIDI process. In addition, the CPU 9 can execute a panel process, a display process and the like, the contents of which are omitted.

(1) Routine of tone-color-select process

When the performer operates the tone-color-select switch to designate the tone-color number TC, the CPU 9 starts to execute the routine of tone-color-select process whose flowchart is shown in FIG. 7. In step S10, the tone-color number TC, which is designated by the performer who operates the tone-color-select switch, is set as the selected-tone-color number KTC. If an input operation to input performance information is carried out by the MIDI device, the tone-color number TC is set to the MIDI-tone-color channel MTCx. In next step S11, it is judged whether or not the selected-tone-color number KTC matches with any one of the loaded-tone-color numbers TCXp in the RAM 11. If a result of judgement is negative (which is described by a term "NO"), in other words, if the attack-waveform data of the designated tone color has not been loaded to the waveform RAM 5 yet, the processing advances to step S12. In step S12, the CPU 9 assigns the selected-tone-color number KTC to one of the loaded-tone-color numbers TCXp. In this case, the number of the loaded-tone-color number to which the selected-tone-color number KTC is assigned is set to the number data i. For example, when the selected-tone-color number KTC is assigned to the loaded-tone-color number TCX2, the number data i indicates a number "2".

In step S13, the CPU 9 performs a searching operation on the RAM 11 by using the selected-tone-color number KTC so as to read out the waveform-file number NM in the tone color data TCDq corresponding to the selected-tone-color number KTC. Then, a certain amount of storage area, corresponding to the waveform-file number NM, is preserved as the attack-waveform-group storage area AWGp (see FIG. 3) in the waveform RAM 5. In step S14, the CPU 9 performs a garbage-collection process to convert the addresses such that an alignment (or sorting) is performed on the waveform RAM 5. For example, when the number data i indicates a number "2", it is indicated that the attack-waveform data to be loaded is written into the attack-waveform-group storage area AWG2; hence, a start address of this attack-waveform-group storage area AWG2 coincides with the start address ASA2. In the above-mentioned garbage-collection process, locations of the data in the memory are not changed but their addresses are only changed by an address converting circuit. Such technique has been already proposed by the present applicant in Japanese Patent Application No.4-189324. The details of the garbage-collection process will be described later.

In step S15, the CPU 9 sends a control signal to the transfer DMA 3. Thus, all of the attack-waveform data, relating to the tone color designated by the selected-tone-color number KTC, are read from the pre-load portion PRq (see FIG. 2) of the magnetic disk; and then, the read attack-waveform data are loaded to the attack-waveform-group storage area AWGp which is preserved in the aforementioned step S13. In this case, the transfer DMA 3 works to load the read attack-waveform-data to the waveform RAM 5 through the time-slot control circuit 7. Thereafter, the processing of the CPU 9 advances to step S16, in which the number data i is set to the position data KTX. As described heretofore, if the attack-waveform data for the designated tone color have not been loaded to the waveform RAM 5 yet, the present apparatus is activated to automatically load it to the waveform RAM 5.

If a result of the judgement performed in step S11 is affirmative (which is described by a term "YES"), in other words, if the attack-waveform data for the designated tone color have been already loaded to the waveform RAM 5, the processing of the CPU 9 directly jumps to step S16, in which the number data i currently set is set to the position data KTX. Thereafter, the processing of the CPU 9 returns back to the main routine.

Figure 10A:
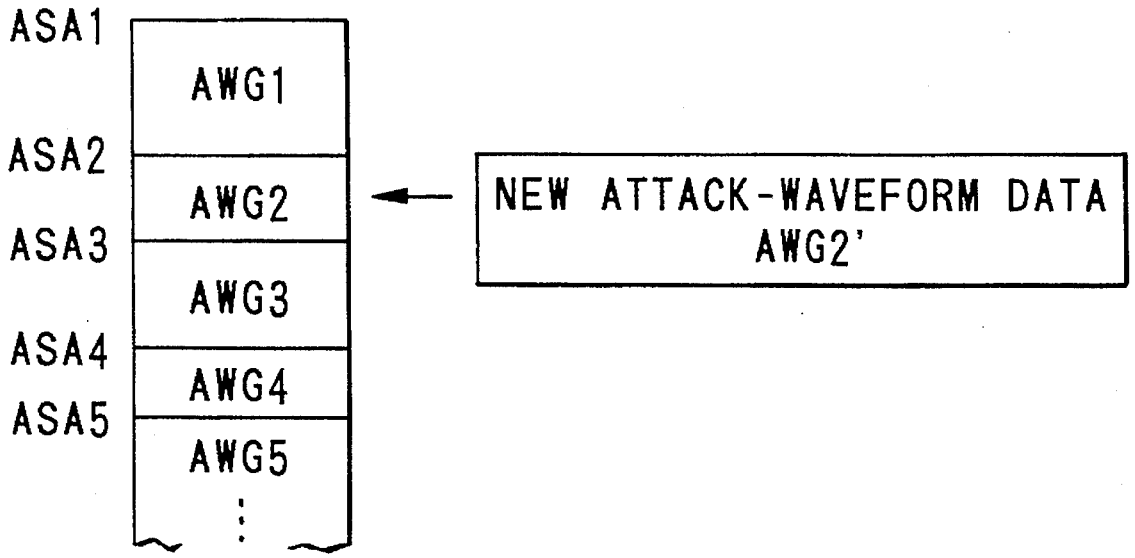
FIGS. 10A and 10B are drawings which are used to explain the contents of the garbage-collection process.
Figure 10B:
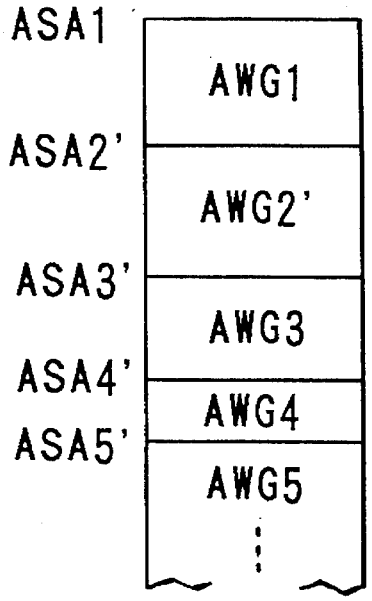

Now, the garbage-collection process will be described in detail by referring to FIGS. 10A and 10B. For example, as shown in FIG. 10A, a plurality of attack-waveform-group storage areas AWG1, AWG2, AWG3, . . . are provided in the waveform RAM 5 such that their start addresses are respectively set at ASA1, ASA2, ASA3, . . . In this case, the transfer DMA 3 is instructed to load new attack-waveform data to the attack-waveform-group storage area AWG2 which is started from the start address ASA2. If the new attack-waveform data requires a storage area AWG2' which is larger than the storage area AWG2, the locations of the attack-waveform-group storage areas AWG3, AWG4, AWG5, . . . should be shifted by a certain amount of storage area which corresponds to a difference between the storage areas AWG2 and AWG2'. Normally, however, such shift in the locations of the storage areas may require much time. For this reason, a certain amount of data, within the new attack-waveform data, which cannot be stored in the storage area AWG2 are loaded to the idle area without changing the locations of the storage areas AWG3, AWG4, AWG5, . . . In this case, an address converting circuit (not shown) is activated to set a new start address ASA2' for the attack-waveform-group storage area AWG2' whose location is put next to the attack-waveform-group storage area AWG1; and then, the start addresses ASA3, ASA4, ASA5, . . . are respectively advanced and converted into start addresses ASA3', ASA4', ASA5', . . . As a result, the configuration of the waveform RAM 5 will be apparently converted to that as shown in FIG. 10B.

(2) Routine of waveform-load process

When the performer operates the waveform-load switch so that the musical-tone-waveform data for the desired tone color are transferred to the waveform RAM 5 from the magnetic disk, the CPU 9 executes the routine of waveform-load process whose flowchart is shown in FIG. 8. By operating the waveform-load switches, the performer designates the tone-color number TC indicating the tone color whose data is loaded to the magnetic disk, and the performer also designates a load-position number of the waveform RAM 5 to which the attack-waveform data is loaded. Herein, the load-position number indicates a number of the attack-waveform-group storage area AWGp. In step S20, the CPU 9 sets the tone-color number TC, which is designated by the performer, to the load-tone-color number BUF; and then, the load-position number is set to the number data i. In next step S21, it is judged whether or not the tone-color number indicated by the load-tone-color number BUF has been already existed in the loaded-tone-color numbers TCXj. When a result of Judgement is "YES", it is proved that the attack-waveform data for the designated tone-color number has been already loaded to the attack-waveform-group storage area AWGj corresponding to a load-position number "j". In this case, the execution of the routine of waveform-load process is terminated, so that the processing of the CPU 9 returns back to the main routine. On the other hand, when the result of Judgement in step S21 is "NO", the processing advances to step S22. In step S22, it is judged whether or not the load-tone-color number BUF is existed in the loaded-tone-color numbers TCXp other than TCXj. If a result of judgement is "YES", the processing branches to step S23, in which an alarm message is displayed by the panel-display circuit 14. This alarm message is used to inform the performer that the attack-waveform data for the designated tone color have been already loaded to a certain storage area which is different from the attack-waveform-group storage area AWGj corresponding to the load-position number designated by the performer. Thereafter, the processing of the CPU 9 returns back to the main routine.

If the result of judgement in step S22 is "NO", the processing advances to step S24. In step S24, the CPU 9 assigns the contents of the load-tone-color number BUF to the loaded-tone-color number TCXj. At the same time, the CPU 9 also performs a searching operation on the RAM 11 by using the load-tone-color number BUF so as to read out the waveform-file number NM in the tone-color data TCDq corresponding to the tone color indicated by the load-tone-color number BUF. The waveform-file number NM represents an amount of the attack-waveform data to be loaded to the attack-waveform-group storage area AWGp corresponding to the load-position number. Thus, the CPU 9 preserves a certain amount of storage area, corresponding to the waveform-file number NM, in the waveform RAM 5. In step S25, the CPU 9 performs the aforementioned garbage-collection process to match the head address of the storage area, which is preserved in step S24, with the start address ASAj. In step S26, the CPU 9 sends a control signal to the transfer DMA 3, so that the attack-waveform data for the tone color corresponding to the load-tone-color number BUF is read from the magnetic disk; and then, the read attack-waveform data is loaded to the preserved storage area in the waveform RAM 5, wherein the preserved storage area is the attack-waveform-group storage area which is designated by the load-position number. Thus, the transfer DMA 3 works to load the read attack-waveform data to the waveform RAM 5 through the time-slot control circuit 7.

(3) Routine of key-on event

When the performer starts the musical performance by using the keyboard, the routine of key-on event, whose flowchart is shown in FIG. 9, is started. The contents of the routine of key-on event will be described by referring to FIG. 9.

At first, when the performer depresses a certain key, its key-on event is detected by the keyboard unit 1 so that the keycode KC and key-on signal KON are correspondingly outputted. In first step S30 in the flowchart shown in FIG. 9, the CPU 9 sets the above keycode KC to the keycode data KCD. In next step S31, the CPU 9 determines the tone-generation channel to which the generation of the musical tone corresponding to the key, on which the key-on event is occurred, should be assigned. Then, the number of the tone-generation channel determined by the CPU 9 is set to tone-generation-channel data ATG. If the tone-generation channel, which is determined by the CPU 9, is now occupied in generating a certain musical tone, the certain musical tone is forced to be damped. In step S32, the CPU 9 performs a searching operation on the RAM 11 so as to find out the register-division data BUN included in the tone-color data TCDq corresponding to the tone color which is indicated by the selected-tone-color number KTC. Then, by referring to the register-division data BUN, the CPU 9 detects the register to which the key indicated by the keycode data KCD belongs. In step S33, the CPU 9 firstly extracts the attack-waveform data stored in the storage area, designated by the position data KTX, within the attack-waveform-group storage areas AWGp provided in the waveform RAM 5. These attack-waveform data to be extracted correspond to the tone color indicated by the selected-tone-color number KTC, i.e., the tone color which is selected by operating the tone-color-select switches. Secondary, the CPU 9 chooses one of these attack-waveform data which corresponds to the register detected by the CPU 9 in step S32; and then, the CPU 9 produces addresses of the chosen attack-waveform data, so that those addresses are supplied to the sound-source circuit 6. For example, when a value "2" is set to the position data KTX so that the number of the register, to which the key indicated by the keycode data KCD belongs, is set at "2", the start address and the end address which define the attack-waveform-data storage area AW2-2 provided in the attack-waveform-group storage area AWG2 are respectively produced as the attack-start address AS and the attack-end address AE.

In step S34, the CPU 9 selects one of the buffers PB1 to PB4; and then, the number of the selected buffer is set to the buffer data ALP. In step S35, the CPU 9 produces the loop-start address LS and the loop-end address LE defining the buffer indicated by the buffer data ALP; and then, those addresses are supplied to the sound-source circuit 6. In step S36, the CPU 9 performs a searching operation on the RAM 11 so as to read out the pitch data PT, the envelope data EGD and the effect data EFCT, all of which relate to the tone color data TCDq representing the tone color designated by the selected-tone-color number KTC. Then, those data, together with the keycode of the keycode data KCD, the tone-color number TC of the selected-tone-color number KTC and the channel number of the tone-generation-channel data ATG, are supplied to the sound-source circuit 6.

In step S37, the CPU 9 determines transfer addresses which are used to transfer the musical-tone-waveform data to the buffer indicated by the buffer data ALP. Herein, the musical-tone-waveform data to be transferred relates to the tone color designated by the selected-tone-color number KTC and the register indicated by the number of register, while the attack-waveform data is excluded from the musical-tone-waveform data to be transferred. Based on the transfer addresses, the transfer DMA 3 is activated to read out the above musical-tone-waveform data from the magnetic disk; and then, the read musical-tone-waveform data is transferred to the buffer indicated by the buffer data ALP. In this case, the waveform-file name for the musical-tone-waveform data to be transferred from the magnetic disk is determined by adding the extension, corresponding to the register currently indicated, to the tone-color-file name FL designated by the selected-tone-color number KTC. The CPU 9 sets the waveform-file name to the transfer DMA 3. In step S38, the CPU 9 sends the key-on signal KON, together with the number of the tone-generation channel indicated by the tone-generation-channel data ATG, to the sound-source circuit 6. In connection with the above tone-generation channel in the sound-source circuit 6, the attack-waveform data is read from the waveform RAM 5, while the transfer DMA 3 transfers a certain amount of the musical-tone-waveform data, which is read from the magnetic disk and from which the attack-waveform data is excluded, to the waveform RAM 5. Herein, the amount of the musical-tone-waveform data to be transferred corresponds to one cluster C.

(4) Operations of the sound-source circuit 6 and transfer DMA 3

Figure 11:
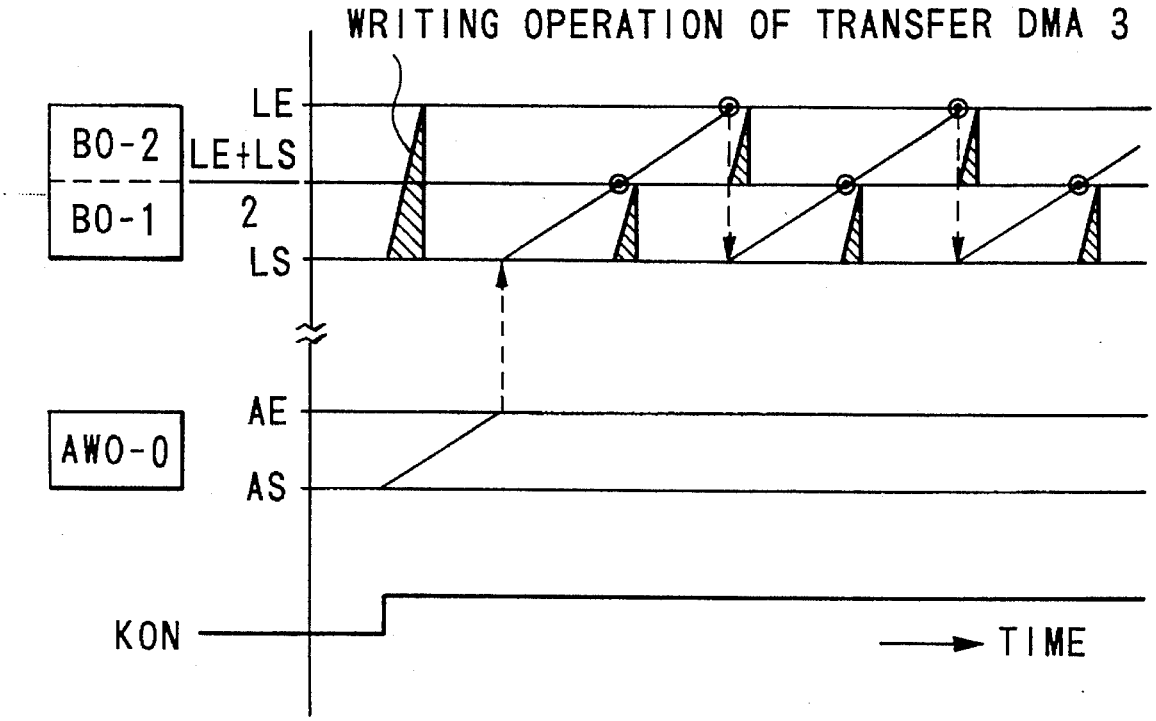
FIG. 11 is a timing chart showing a relationship between operations of an address counter and operations of a transfer DMA.

Next, the operations of the sound-source circuit 6 and the transfer DMA 3, which are activated after the key-on signal KON is supplied to the sound-source circuit 6, will be described by referring to FIGS. 11 and 12. In a timing chart shown in FIG. 11, when the key-on signal KON is supplied to the sound-source circuit 6, the address counter (see FIG. 5) reads out the attack-waveform data from the waveform RAM 5 by using the address data AD. As described before, the address data AD is a result of the addition in which the attack-start address AS is added with the integral part of the accumulated value in which the frequency numbers 'F' are accumulated for a certain period of time. While the above attack-waveform data is read from the waveform RAM 5, the transfer DMA 3 firstly reads out a certain amount of the musical-tone-waveform data, which represents the remaining portion of the musical tone waveform continued from the attack portion indicated by the attack-waveform data, from the magnetic disk, wherein the amount of the musical-tone-waveform data to be read out corresponds to one cluster; and then, the read musical-tone-waveform data is written into the buffer area, defined by the loop-start address LS and the loop-end address LE, in the waveform RAM 5.

Thereafter, when a reading operation for the attack-waveform data is completed from the attack-start address AS to the attack-end address AE, the address counter 63 advances its read-out address from the attack-end address AE to the loop-start address AS. The aforementioned buffer area starts from this loop-start address AS. When the reading operation is performed with respect to a half of the buffer area, in other words, when the read-out address set by the address counter 63 is advanced from the loop-start address LS to an address defined by "(LS+LE)/2", the address counter 63 sends a half-read-completion information to the transfer DMA 3. Herein, the half-read-completion information declares that the reading operation has been completed with respect to a former-half portion of the buffer area. Upon the receipt of the half-read-completion information, the transfer DMA 3 reads one cluster of the musical-tone-waveform data from the magnetic disk so as to write it into the former-half portion of the buffer area, which ranges from the loop-start address LS to the address "(LS+LE)/2". Thereafter, the read-out address set by the address counter 63 is advanced from the address (LS+LE)/2 to the loop-end address LE so that the reading operation is performed on a latter-half portion of the buffer area. When the read-out address coincides with the loop-end address LE, the address counter 63 sends a read-end signal SIG to the transfer DMA 3, wherein this signal SIG declares that the reading operation has been completed with respect to the latter-half portion of the buffer area. Upon the receipt of the read-end signal SIG, the transfer-DMA 3 reads another cluster of the musical-tone-waveform data from the magnetic disk so as to write it into the latter-half portion of the buffer area. At the same time, the address counter 63 returns its read-out address to the loop-start address LS. Thereafter, the reading operation is performed on the former-half portion and latter-half portion of the buffer area; and then, when completing the reading operation, the address counter 63 sends the read-end signal to the transfer DMA 3. As described above, under the operations of the address counter 63, the data are repeatedly read from the buffer area defined by the loop-start address LS and the loop-end address LE.

Figure 12:
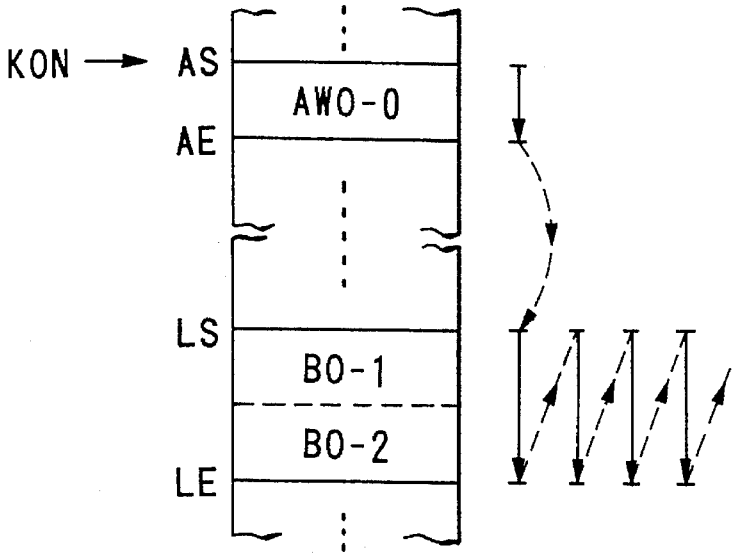
FIG. 12 is a drawing showing a manner of changing the read-out address set by the address counter.

A manner of changing the read-out address of the address counter 63 is shown in FIG. 12. As shown in FIG. 12, when the attack-waveform data is completely read from the storage area which ranges from the attack-start address AS to the attack-end address AE, the address counter 63 returns its read-out address to the loop-start address LS. In other words, the read-out address of the address counter 63 is altered as LS→LE →LS→ LE . . . , so that the data of the buffer area are repeatedly read out.

Thereafter, the interpolation circuit 64 performs an interpolation operation, using the interpolation data Frac given from the address counter 63, on the musical-tone-waveform data which are read out from the buffer area as described above. The output of the interpolation circuit 64 is multiplied by the envelop signal ENV by the multiplier 66. Then, the effecter 67 imparts a certain effect to the output of the multiplier 66. The musical tone signal, corresponding to the output of the effecter 67, is supplied to the accumulation circuit 68 with respect to each tone-generation channel. The waveform values included in this musical tone signal are accumulated by the accumulation circuit 68. The output of the accumulation circuit 68 is converted into the analog signal by the D/A converter 69. Thus, the sound system 8 produces the corresponding musical tone.

[C] Modification

In the present embodiment described heretofore, the production of the musical tone is assigned to the tone-generation channel of the sound-source circuit 6 when the key-on event is occurred; and then, one of the buffers is designated. Instead, it is possible to establish a fixed relationship between each of the buffers and each of the tone-generation channels, provided in the sound source circuit 6, in advance. In this case, the production of the musical tone is assigned to a fixed pair of the tone-generation channel and buffer.

The present embodiment may have a function enabling the reproduction of the sound in accordance with a reproduction instruction on the basis of the instantaneous values of the waveform. The function of the present embodiment can be applied to a so-called play-sheet function of the sampler and a so-called cue-list reproduction of the disk recorder. Herein, the play-sheet function is the function in which plural sounds are continuously reproduced by connecting different kinds of waveforms, while the cue-list reproduction represents a manner of reproduction in which the reproduction of the sounds is performed by referring to the cue list storing reproduction-start timings of the waveforms. Thus, it is possible to increase the speed of producing the sounds; and, it is possible to reduce the working power for the programming.

[D] Effects of the Invention

As described heretofore, the present embodiment provides the attack-waveform-group storage areas AWGp for storing the attack-waveform data and the buffers PB1 to PB4 for the long-time reproduction in the waveform RAM 5, wherein one of the buffers PB1 to PB4 is assigned to the plural tone-generation channels. Thus, it is possible to simultaneously produce the plural musical tones.

In addition, the plural kinds of the attack-waveform data, to each of which a tone-generation instruction is given, are transferred from the magnetic disk to the waveform RAM 5 in advance before actually receiving the tone-generation instruction. Then, when the tone-generation instruction is given, one of the plural kinds of the attack-waveform data, which corresponds to the tone-generation instruction, is selectively read from the waveform RAM 5. At the same time, the musical-tone-waveform data, which corresponds to the tone-generation instruction and which represents the remaining portion of the musical tone waveform continued from the attack portion corresponding to the attack-waveform data selectively read from the waveform RAM 5, are sequentially transferred from the magnetic disk to the waveform RAM 5. Thus, even when the external storage device such as the magnetic disk unit 2 is used, it is possible to produce the musical tone signal, which has a specific characteristic in the musical tone waveform with respect to each tone-generation instruction, at a good timing without a delay of time.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A musical tone forming apparatus comprising:

external storage means for storing first and second waveform data with respect to a waveform of a musical tone, said first waveform data relating to an attack portion of the waveform, while said second waveform data relates to a remaining portion of the waveform, said second waveform data being divided into a plurality of data when being stored in said external storage means;

waveform memory means which provides an attack-waveform storage area and a buffer storage area, said attack-waveform storage area being provided to store said first waveform data, while said buffer storage area is provided to store said second waveform data such that said plurality of data are sequentially stored in said buffer storage area;

transfer means for transferring said first waveform data, read from said external storage means, to said attack-waveform storage area before a production of the musical tone, whereas when a tone-generation instruction, which activates a musical tone to be generated, is given, said transfer means transfers said second waveform data, read from said external storage means, to said buffer storage area such that said plurality of data are sequentially transferred to said buffer storage area; and musical-tone-signal forming means, activated when the tone-generation instruction is given, for forming a musical tone signal in such a manner that the attack portion of the musical tone signal is firstly formed on the basis of said first waveform data stored in said attack-waveform storage area, and then, the remaining portion of the musical tone signal is formed on the basis of said second waveform data stored in said buffer storage area, wherein said transfer means transfers said second waveform data in synchronism with a formation of the remaining portion of the musical tone signal formed by said musical-tone-signal forming means.

2. A musical tone forming apparatus according to claim 1 wherein said musical-tone-signal forming means further contains an address counter which is used to perform a reading operation at a read-out speed, whose value is variable, with respect to each of said attack-waveform storage area and said buffer storage area.

3. A musical tone forming apparatus according to claim 1 wherein said musical-tone-signal forming means firstly reads out said first waveform data from said attack-waveform storage area so as to form the attack portion of the musical tone signal, and then, said musical-tone-signal forming means repeatedly performs a reading operation on said buffer storage area, to which said plurality of data are sequentially transferred, so as to sequentially read out said plurality of data, by which the remaining portion of the musical tone signal is formed.

4. A musical tone forming apparatus according to claim 1 wherein said external storage means is a magnetic disk unit, while said waveform storage means is configured by a random-access memory.

5. A musical tone forming apparatus comprising:

external storage means for storing plural sets of first and second waveform data, said first waveform data relating to an attack portion of a musical tone waveform, while said second waveform data relates to a remaining portion of the musical tone waveform, said second waveform data being divided into a plurality of data when being stored in said external storage means;

waveform memory means which provides an attack-waveform storage area and a buffer storage area, said attack-waveform storage area having a storage capacity which can store a plurality of said first waveform data, while said buffer storage area is provided to store said second waveform data such that said plurality of data are sequentially stored in said buffer storage area;

transfer means for transferring said plurality of said first waveform data, all of which are read from said external storage means, to said attack-waveform storage area before a production of the musical tone, whereas when a tone-generation instruction, which activates a musical tone to be generated, is given, said transfer means transfers said second waveform data, which corresponds to the tone-generation instruction and which is read from said external storage means, to said buffer storage area such that said plurality of data are sequentially transferred to said buffer storage area; and musical-tone-signal forming means, activated when the tone-generation instruction is given, which selects one of said plurality of said first waveform data in accordance with the tone-generation instruction so that said first waveform data selected is used to form the attack portion of the musical tone signal at first, and then, the remaining portion of the musical tone signal is formed on the basis of said second waveform data whose plurality of data are sequentially read from said buffer storage area.

6. A musical tone forming apparatus according to claim 5 further comprising tone-color designating means for designating a tone color for a musical performance to be played, so that said transfer means selectively transfers one of said plurality of said first waveform data, which is read from said external storage means, to said attack-waveform storage area in response to the tone color designated by said tone-color designating means.

7. A musical tone forming apparatus according to claim 6 further comprising detecting means, activated before said transfer means transfers said first waveform data, corresponding to the tone color designated, to said attack-waveform storage area, for detecting whether or not said first waveform data has been already stored in said attack-waveform storage area, so that when said detecting means detects that said first waveform data has been already stored in said attack-waveform storage area, said transfer means stops transferring said first waveform data.

8. A musical tone forming apparatus according to claim 6 further comprising sorting means, activated before said transfer means transfers said first waveform data, corresponding to the tone color designated, to said attack-waveform storage area, for sorting a plurality of said first waveform data, which are currently stored in said attack-waveform storage area, so as to create an idle area within said attack-waveform storage area, so that said transfer means transfers said first waveform data, corresponding to the tone color designated, to said idle area.

9. A musical tone forming apparatus according to claim 8 wherein said sorting means changes addresses of said plurality of said first waveform data so as to apparently sort them without actually changing their stored locations in said attack-waveform storage area.

* * * * *